United States Patent [19]

Fleischer

[11] 4,071,742

[45] * Jan. 31, 1978

[54] ROTARY ELECTROMAGNETIC INDICATOR SYSTEM

[75] Inventor: Donald Whiting Fleischer, Wethersfield, Conn.

[73] Assignee: Veeder Industries, Inc., Hartford, Conn.

[ * ] Notice: The portion of the term of this patent subsequent to Mar. 15, 1994, has been disclaimed.

[21] Appl. No.: 706,129

[22] Filed: July 16, 1976

Related U.S. Application Data

[63] Continuation-in-part of Ser. No. 584,216, June 5, 1975, Pat. No. 4,012,623.

[51] Int. Cl.[2] ..... B67D 5/06; G08B 28/00; G06M 1/10

[52] U.S. Cl. ..... 235/92 FL; 222/28; 235/92 A; 235/92 R

[58] Field of Search ..... 235/92 C, 92 A, 92 FL; 340/319, 378 MW; 335/181; 310/156; 222/28

[56] References Cited

U.S. PATENT DOCUMENTS

| | | | |
|---|---|---|---|
| 3,403,272 | 9/1968 | Dold | 235/92 A |
| 3,478,349 | 11/1969 | Buuck et al. | 340/378 MW |
| 3,576,975 | 5/1971 | Maass | 235/92 A |
| 4,012,623 | 3/1977 | Fleischer | 235/92 A |

*Primary Examiner*—Joseph M. Thesz
*Attorney, Agent, or Firm*—Prutzman, Hayes, Kalb & Chilton

[57] ABSTRACT

Gasoline dispensing apparatus with cost and volume registers composed of banks of rotary electromagnetic indicators, each having a two-coil electromagnetic stator for indexing a respective rotary indicator wheel, and a drive circuit for accumulating the cost and volume of fuel delivered and for indexing the indicator wheels of the banks thereof for registering the cost and volume of fuel delivered. The drive circuit is operable for indexing each indicator wheel with multiple step indexing cycles providing a predetermined multiple step energization sequence of the two coils of the electromagnetic stator. The drive circuit is operable for resetting the counter wheels by indexing the wheels in the forward direction to their "9" positions and then nine counts in the reverse direction to their "0" count positions where the wheels are retained against further reverse rotation by one-way locking pawls.

29 Claims, 6 Drawing Figures

ROTARY ELECTROMAGNETIC INDICATOR SYSTEM

The present application is a continuation-in-part application of my copending application Ser. No. 584,216 filed June 5, 1975 and entitled "Counting and Indicating System, now U.S. Pat. No. 4,012,623 dated Mar. 15, 1977,"

SUMMARY OF THE INVENTION

The present invention relates to a new and improved rotary electromagnetic indicator system having notable utility in fuel dispensing apparatus for registering the volume and/or cost amount of fuel delivered.

It is a primary aim of the present invention to provide a new and improved rotary electromagnetic indicator system for fuel dispensing apparatus which provides improved operation and reliability in the registration of the volume and/or cost amount of fuel delivered.

It is another aim of the present invention to provide a new and improved volume and/or cost counters for a fuel pump register providing a visual readout which may be the same as or similar to the visual volume and/or cost readouts of conventional mechanical fuel pump registers and whereby its appearance to the customer may be made to be the same or similar.

It is a further aim of the present invention to provide a new and improved relatively low cost and high speed rotary electromagnetic decade indicator.

It is another aim of the present invention to provide in a counting and indicating system of the type employing one or more rotary counter wheels, a new and improved electromagnetic indexing system operable for electromagnetically indexing the counter wheels for accumulating a count and for resetting the counter wheels to zero.

It is another aim of the present invention to provide in a counting and indicating system of the type having an electronic storage register for storing a count and one or more rotary indicators for displaying the stored count, a new and improved indexing system for indexing each rotary indicator for registering the corresponding stored digit count of the electronic storage register.

It is a further aim of the present invention to provide a new and improved reset system for a rotary electromagnetic decade indicator for resetting the decade indicator to "0" or other predetermined reset position.

It is a further aim of the present invention to provide a new and improved rotary electromagnetic indicator of the type having a permanent magnet indicating rotor and a stator with a stator core with an annular arrangement of a plurality of salient poles and salient pole windings adapted to be selectively energized for magnetically indexing the rotor.

It is another aim of the present invention to provide a new and improved rotary electromagnetic counting system operable at a relatively high counting rate.

It is another aim of the present invention to provide in a rotary electromagnetic decade counter, a new and improved stator pole arrangement for accurately locating a rotary decade wheel of the decade counter at each full count position thereof and a new and improved method of operation for reducing or eliminating counter wheel overshoot as the counter wheel is indexed from one count position to the next count position.

It is a further aim of the present invention to provide a new and improved rotary electromagnetic counting system for indexing a rotary counter wheel in analogue fashion.

It is another aim of the present invention to provide a new and improved rotary electromagnetic decade counter of the type having a permanent magnet rotor and a pair of stator windings adapted to be selectively energized for indexing the rotor to each of ten equiangularly spaced positions.

It is another aim of the present invention to provide a new and improved single wheel rotary indicator module usable alone or in a bank thereof as a numeral display or the like.

Other objects will be in part obvious and in part pointed out more in detail hereinafter.

A better understanding of the invention will be obtained from the following detailed description and the accompanying drawings of illustrative applications of the invention.

DESCRIPTION OF THE PREFERRED EMBODIMENTS

Figure 1:
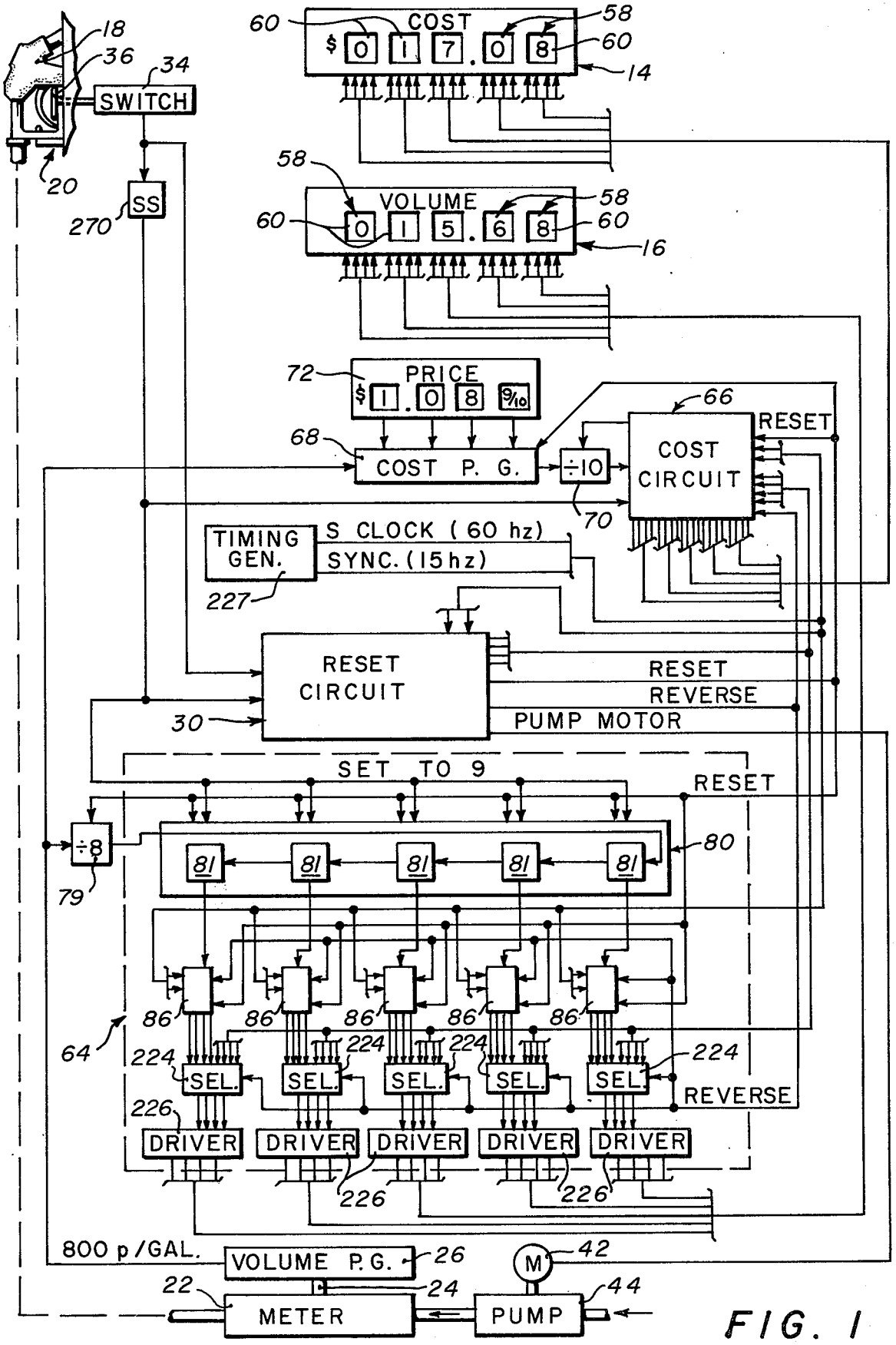
FIG. 1 is a combined diagrammatic illustration and functional schematic, partly broken away, of gasoline dispensing apparatus incorporating an embodiment of a rotary electromagnetic indicator system of the present invention.

Referring now to the drawings in detail wherein like reference numerals indicate like parts throughout the several figures, a gasoline dispensing pump 10 employing cost and volume registers 14, 16 respectively incorporating the present invention is shown having a nozzle 18 for delivering fuel and a suitable nozzle storage receptacle 20 for storing the nozzle 18 between fuel deliveries. In a conventional manner, a meter 22 mounted in a fuel conduit leading to the nozzle 18 has a rotary output shaft 24 driven in accordance with the volume amount of fuel delivered. The meter shaft 24 is connected to drive a suitable pulse generator 26 for generating a train of electrical volume pulses with a pulse for each predetermined volume increment of fuel dispensed, in the shown embodiment for generating 800 pulses for each gallon unit volume on which the fuel unit volume price is based. For example, the pulse generator 26 may be a rotary pulse generator of the type described in U.S. Pat. No. 3,786,272 of John G. Gamble et al dated Jan. 15, 1974 and entitled "Hall Effect Rotary Pulse Generator".

For the purpose of understanding the manner of operation of the rotary electromagnetic indicator system of the present invention, functional schematics of indicator drive circuits are shown and described hereinafter and the drive circuits are preferably provided by suitable microprocessors.

A register reset circuit 30 (hereinafter described) is selectively operated by a control switch 34 actuated by a handle 36 for resetting the cost and volume registers 14, 16 just prior to the commencement of each fuel delivery. The register control handle 36 is positioned adjacent the nozzle storage receptacle 20 and such that the handle 36 has to be rotated to its vertical or "off" position to open the control switch 34 to permit the nozzle 18 to be placed in its storage receptacle at the completion of a fuel delivery, and the nozzle 18 has to be removed from its storage receptacle 20 to permit the handle 36 to be rotated to its horizontal or "on" position to close the switch 34. Rotation of the handle 36 to its vertical or "off" position provides for resetting a motor control latch 40 (FIG. 2) to de-energize a drive motor 42 for a delivery pump 44, and rotation of the handle 36 to its horizontal or "on" position provides for operating the reset circuit 30 for resetting the cost and volume registers 14, 16 to zero and then set the motor control latch 40 for re-energizing the motor 42 and thereby condition the dispensing system for delivering fuel.

Referring to FIG. 1, each register 14, 16 comprises a bank of five rotary indicators or decade modules 58 of increasing order of significance with corresponding number wheels 60. A volume circuit 64 (hereinafter described) is operable for accumulating a count of the volume amount of fuel dispensed and for indexing the bank of volume indicators 58 for registering the accumulated volume count. A cost circuit 66 (which is functionally identical to the volume circuit 64 and is therefore not described in detail) is operable for accumulating a count of the cost amount of fuel dispensed and for indexing the cost indicators 58 for registering the cost count. Also, as hereinafter described, the volume and cost circuits 64, 66 are connected to be operated by the reset circuit 30 for resetting the volume and cost indicator wheels 60 and "0" when the handle 36 is turned to its horizontal or "on" position and just prior to the commencement of a fuel delivery.

The volume circuit 64 comprises a BCD counter 80 having five separate BCD storage decades or counters 81 of ascending order of significance for the five volume indicator modules 58 respectively. The volume pulse generator 26 is connected via a divide-by-eight input counter section 79 to the lowest order BCD storage decade 81 of the counter 80, and in a conventional manner, each lower order BCD storage decade 81 is connected to transmit a carry or transfer pulse to the adjacent higher order decade 81 for each ten input pulses to the lower order decade 81. The BCD counter 80 and input counter section 79 are connected to the reset circuit 30 to be reset between fluid deliveries (after the volume indicator wheels 60 are reset, as explained more fully hereinafter). During the following delivery of fuel, the BCD counter 80 is indexed to accumulate the cost amount of fuel delivered, it being seen that the input counter section 79 produces a count or transfer pulse for indexing the lowest order BCD decade 81 for each eight pulses from the pulse generator 26 and therefore for each one hundredth of a gallon of fuel dispensed. The pulse generator 26 is not reset in the described embodiment when the registers 14, 16 are reset (although, if desired, suitable additional means could be provided for resetting the pulse generator 26), and therefore the input counter section 79 is preferably reset to a four count condition and such that each hundredth gallon pulse transmitted to the lowest order decade 81 is timed to occur at approximately midway during the delivery of the respective hundredth gallon increment of fuel.

A suitable cost pulse generator 68 and a divide-by-ten input counter section 70 are provided for transmitting a train of one cent or hundredth cost pulses to the cost circuit 66. The cost pulse generator 68 is connected to a suitable price selector 72 and to the volume pulse generator 26 to generate an appropriate train of thousandths pulses (each representing $0.001) for each volume pulse and so that the cost accumulator (not shown) of the cost circuit 66 accurately accumulates the cost of fuel delivered to the nearest cent. The input cost counter section 70 is preferably reset to a five count when the cost accumulator is reset and such that each hundredth or one cent cost pulse transmitted to the cost accumulator (not shown) occurs approximately midway during the delivery of the respective hundredth or one cent increment of fuel.

Figure 2:
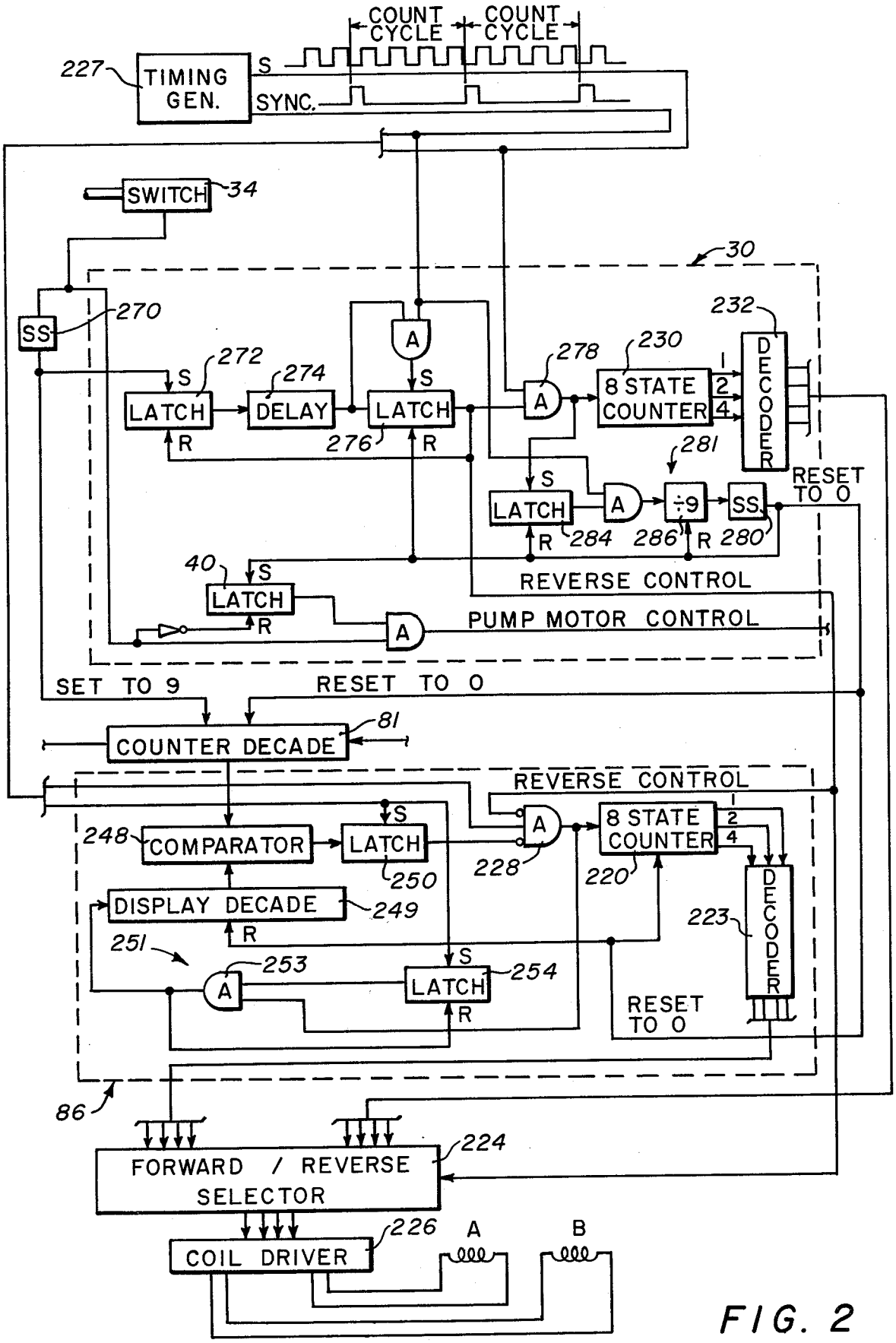
FIG. 2 is a combined diagrammatic illustration and functional schematic, partly broken away, showing an indicator drive circuit of the indicator system.

In the embodiment of FIGS. 1 and 2, the rotary decade modules 58 are identically operated and therefore, for simplicity of illustration, a functional schematic of a forward drive circuit 86 for operating a pair of stator coils A and B of a single decade module 58 is shown in FIG. 2.

Figure 4:
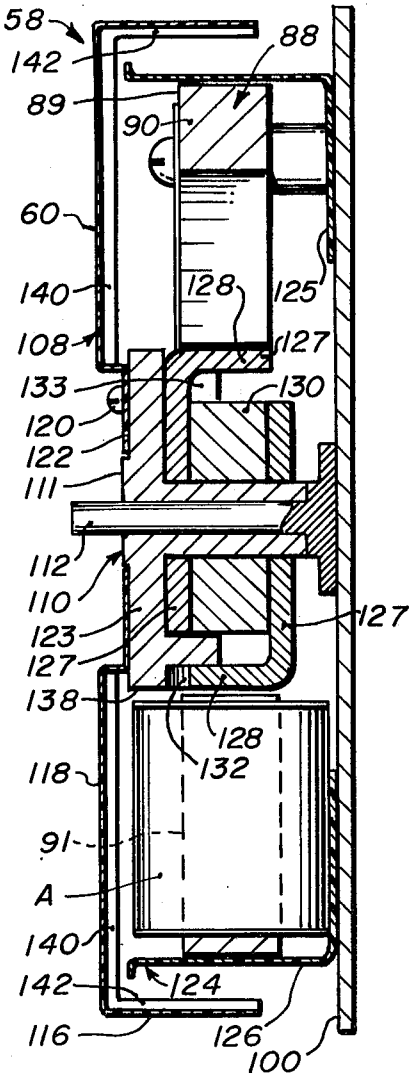
FIG. 4 is an enlarged front elevation section view, partly broken away and partly in section, of the indicator module.
Figure 3:
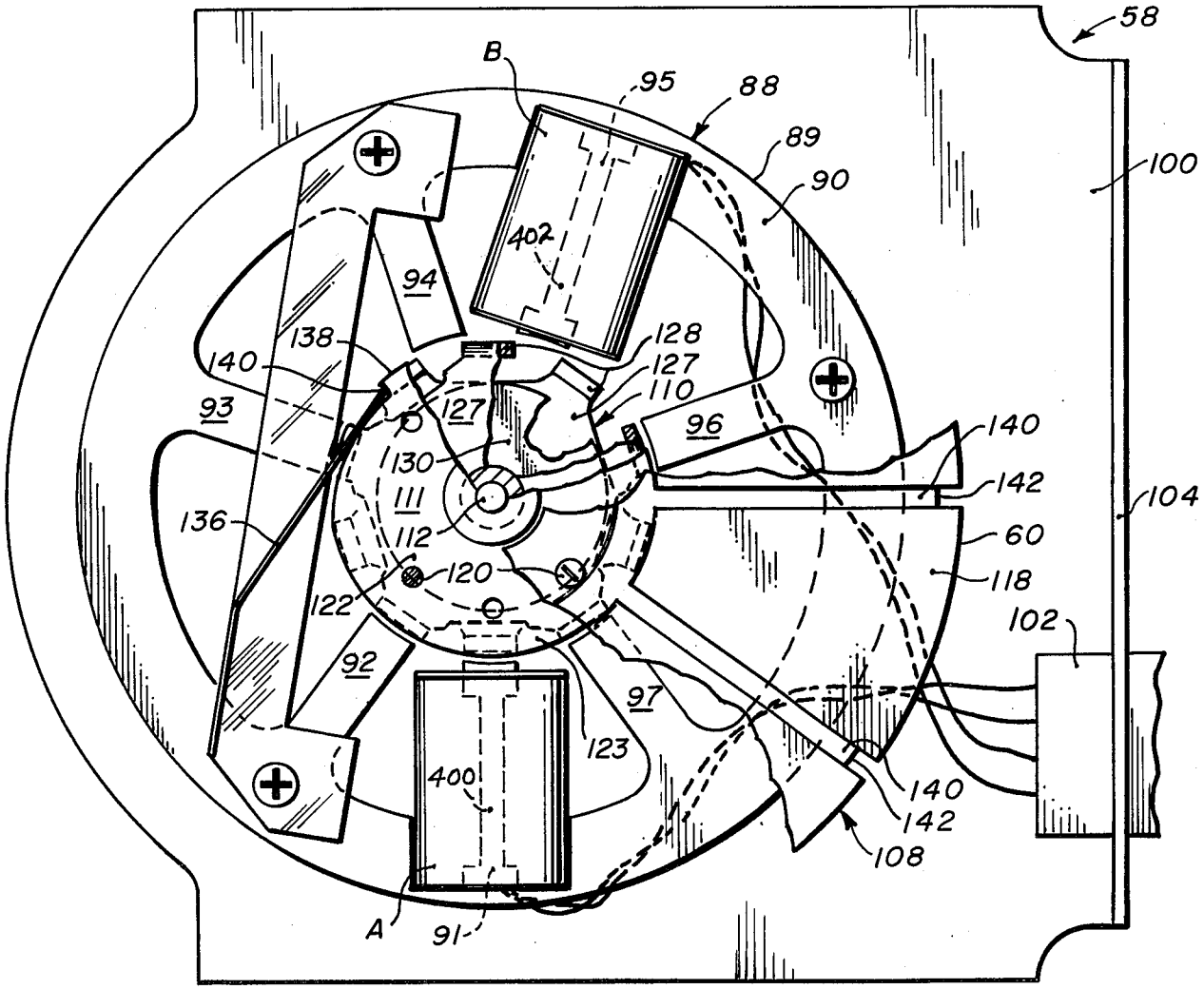
FIG. 3 is an enlarged elevation side view, partly broken away and partly in section, of a rotary indicator module of the indicator system.

Referring to FIGS. 3 and 4, each rotary number wheel 60 is adapted to be selectively electromagnetically stepped to each of its 0–9 count positions. For that purpose, the rotary decade module 58 comprises a stator 88 having a generally flat stator core 89 with an outer circular ring 90 and seven angularly spaced radially inwardly extending salient poles 91–97 and "primary" and "secondary" salient pole windings A and B respectively on the "primary" and "secondary" salient poles 91 and 95 respectively. The stator core 89 (which, for example, may be made of flat soft iron laminations) is mounted on a frame 100, and a suitable electrical connector 102 mounted on a rear flange 104 of the frame 100 is provided for electrical connection to the four leads to the A and B stator coils.

The rotary decade module 58 has a rotor 108 with a central permanent magnet hub assembly 110 with a plastic support hub 111 rotatably mounted on a stub shaft 112 secured to the frame 100. The number wheel 60 of the rotor 108 is formed of thin plastic with an outer 0–9 numeral bearing rim 116 encircling the stator ring 90 and an intermediate rim support web 118 secured by fasteners 120 to an outer end face 122 of a generally circular end flange 123 of the support hub 111. A thin plastic dust shield 124 having a base 125 secured to the frame 100 and a peripheral axially extending circular end flange 126 intermediate the stator and numeral bearing rim 116 provides for protecting the decade module 58 from foreign matter.

A pair of identical axially spaced and oppositely facing coaxial pole pieces 127 are mounted on the plastic support hub 111. Each of the pole pieces 127 has five equiangularly spaced (i.e., 72° spaced) axially extending segments or poles 128, each having an 18° wide pole face, and the two pole pieces 127 are mounted on the support hub 111 to provide an annular arrangement of ten equiangularly spaced poles 128. A circular axially magnetized permanent magnet 130 is mounted coaxially between and in engagement with the pole pieces 127 so that the five poles 128 of each pole piece 127 have the same polarity and the ten poles of the annular pole arrangement have alternating polarity. The support hub 111 is molded with ten equiangularly spaced slots 132, 133 in the end flange 123 for receiving and thereby angularly retaining the poles 128 of the two pole pieces 127 respectively. The inner pole piece 127 is press fit into the plastic support hub 111, and the circular permanent magnet 130 and outer pole piece 127 are axially retained in assembled condition by the magnetic attraction of the intermediate permanent magnet 130 and oppositely facing pole pieces 127.

The number wheel 60 is electromagnetically indexed in the forward or additive direction, in the clockwise direction as viewed in FIG. 3, by the selective and timed energization of the A and B stator coils to index the number wheel 60 in stepwise fashion in the manner of a digital counter wheel. A one-way locking pawl 136 provided in the form of a light leaf spring is mounted on the stator core ring 90 for engagement with a peripheral cam edge 138 on the end flange 123 of the support hub 111. The cam edge 138 has a single shoulder or stop 140 engageable by the pawl 136 when the wheel 60 is rotated in the reverse or subtracting angular direction slightly beyond its "0" count position (i.e., about one-fourth of a count or 9°) beyond its "0" count position toward its "9" count position.

In accordance with one feature of the present invention, the plastic number wheel 60 is vacuum formed from a suitable thermoplastic sheet of material (e.g. ABS) and at a suitable temperature at which the sheet is relatively plastic. The original sheet of material is preferably about 0.020 inches thick and so as to provide an indicia bearing rim 116 and supporting web 118 which are very thin (e.g. about 0.010 inches thick) and whereby the plastic wheel 60 has a very low moment of inertia. The web 118 is vacuum formed with ten equiangularly spaced radially extending semicircular reinforcing ribs 140 and the rim 116 is similarly vacuum formed with axially extending semicircular reinforcing ribs 142. The axial reinforcing ribs 142 are equiangularly spaced and positioned intermediate the equiangularly spaced 0–9 numerals, and the radial reinforcing ribs 140 are preferably angularly aligned with the axially extending ribs 142. The 0–9 indicia are printed directly onto the rim 116 after the flat plastic sheet is vacuum formed into the wheel 60. As the 0–9 indicia are preferably printed in white, the wheel is preferably formed from a black plastic providing a contrasting background. A number wheel 60 so constructed has been found to be very light and have a very low moment of inertia and yet be structurally rigid and durable.

In each of the ten equiangularly spaced count positions of the wheel 60, one of the ten rotor poles 128 of one polarity is radially aligned with the "primary" stator pole 91, and four other rotor poles 128 of opposite polarity (i.e., on the other pole piece 127) are radially aligned with the stator poles 92, 93, 96 and 97 having a 72° spacing and symmetrically arranged relative to the "primary" stator pole 91. The five salient poles 91–93, 96 and 97 therefore provide a magnetic circuit, hereinafter referred to as the "primary" magnetic circuit, of the stator for magnetically attracting the rotor to and detenting it at a full count position. And, even with the "primary" or A coil de-energized, the five stator poles 91–93, 96 and 97 provide an effective and preferred magnetic detent for holding the number wheel 60 at a full count position. Accordingly, the "primary" or A stator coil (as well as the "secondary" or B stator coil) can be and is maintained de-energized between counts to save power. Such is particularly beneficial in a loss of power condition for eliminating the need for a backup battery power source.

The remaining two salient poles 94, 95 of the stator are angularly positioned 36° apart and one-half count or 18° out of phase with a generally diametrically opposed to the stator poles of the "primary" magnetic circuit and form with the B or "secondary" coil mounted on the "secondary" stator pole 95, a "secondary" magnetic circuit for initiating rotation of the rotor in either angular direction from a full count position. Thus, by selectively establishing the magnetic polarity of the salient poles of the "secondary" magnetic circuit with the "secondary" or B coil, the direction of rotation of the rotor from its full count position can be selectively established.

Figure 5:
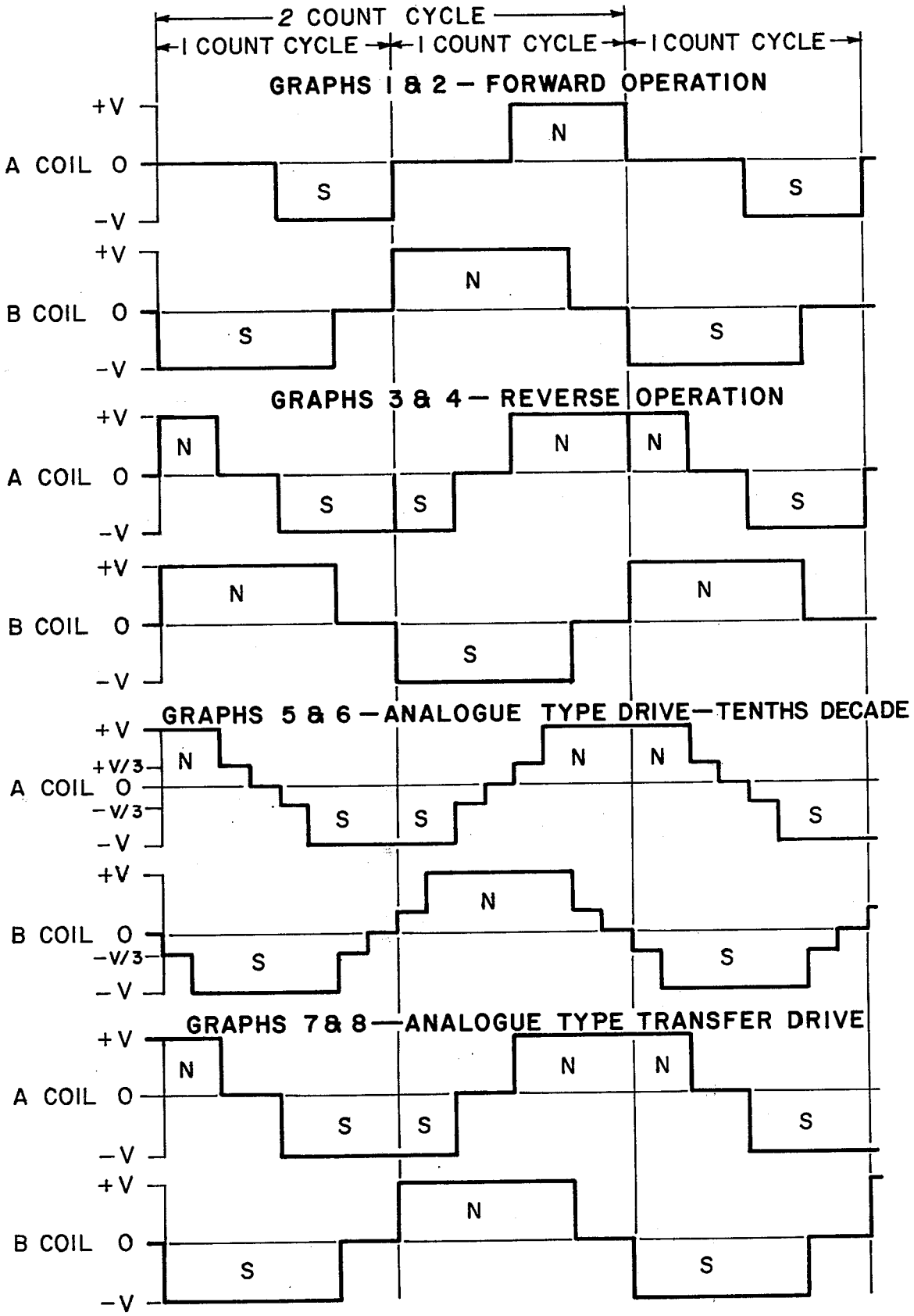
FIG. 5 is a graph illustration of several different types of multiple phase coil energization cycles provided by the indicator drive circuit of FIG. 2 and the modified indicator drive circuit of FIG. 6.

Referring to graphs 1 and 2 of FIG. 5, the number wheel 60 is indexed from a prior count to the next count (in the additive or forward angular direction) by a two phase count cycle based on a four equal time increment division of the count cycle. Upon reference to the A and B coil graphs, it can be seen that each count cycle consists of the following: (a) energizing the "secondary" or B coil (which functions in part in determining the direction of rotation) during the first three time increments of the four increment count cycle in the appropriate direction to rotate the number wheel in the forward direction; and (b) energizing the "primary" or A stator coil during the last two time increments of the count cycle in the appropriate direction for rotating the rotor in the same direction to the next full count position. The "secondary" or B coil is maintained energized for the third time increment to oppose the continuing rotation of the rotor in the desired direction and thereby assist in decelerating the rotor to reach its full count position at approximately the end of the third time increment and where it is then retained by the "primary" magnetic circuit (with both A and B coils de-energized). The fourth time increment with only the "primary" coil energized provides for ensuring that the rotor is at rest at its full count position at the end of the count cycle. Thus, the A and B stator coils are timely energized to index the wheel to each successive count position and at the end of each count cycle with the wheel 60 magnetically locked in the full count position by the preferred magnetic detenting provided by the "primary" magnetic circuit of the stator. Thus, as there are only two stator poles 94, 95 in the "secondary" magnetic circuit, the five stator poles of the "primary" magnetic circuit will dominate the detenting function and ensure that the wheel remains centered at each count position at the end of a count cycle.

Each succeeding count cycle follows the same multiple phase indexing operation except that the polarities are reversed (as shown in graphs 1 and 2 of FIG. 5) in accordance with the alternating polarity of the ten rotor poles 128. Thus, for counting, the A and B coils are energized through a repeating two-count cycle having eight equal time increment divisions.

For indexing the counter wheel in the reverse direction, a similar multiple phase indexing operation with the polarity of the direction coil B reversed is used as shown in graphs 3 and 4 of FIG. 5. In addition, the "primary" or A coil is energized during the first time increment (of the four equal time increment division of the reverse counting cycle) in the direction opposing the desired reverse rotation of the counter wheel 60. As a result, the counter wheel is indexed approximately one-fourth of a count or 9° during the first time increment, and also during the second, third and last time increments and whereby the reverse rotation is effected smoothly at a relatively low wheel speed. The described low speed reverse indexing cycle is used to minimize any wheel bounce off of the reverse locking pawl 136 (if the wheel 60 is indexed in the reverse direction beyond "0" into engagement with the reverse locking pawl 136 during the reverse reset phase of the reset cycle) and thereby preclude any succeeding forward rotation of the wheel (by any remaining reverse reset steps) with the wheel rotor out of synchronization with the coil energization cycle.

Referring to FIG. 2, each forward drive circuit 86 comprises an eight state binary counter 220 (i.e., having eight states or counts corresponding to the eight equal time increments or divisions of a repeating two count coil energization cycle) connected to be stepped for operating the A and B coils in sequence as described for indexing the number wheel in the forward or additive counting direction. The binary output of the forward counter 220 is connected via a suitable forward decoder 223, a forward/reverse selector 224, and a suitable coil drive circuit 226 to energize the A and B coils in accordance with the state or count of the forward counter 220. The forward counter 220 is connected via an input control gate 228 to a timing generator 227 to be selectively stepped by a 60 hz clock or stepping pulse designated "S". The timing generator also provides a 15 hz synchronization or "sync" pulse at the established count frequency for synchronizing the various drive circuit functions as will be hereinafter understood.

The reset circuit 30 also employs an eight state binary counter 230 connected via a reverse decoder 232, the forward/reverse selector 224 and the coil driver 226 for indexing the indicator wheel in the reverse angular direction using the coil energization cycle shown in graphs 3 and 4 of FIG. 5. During the delivery of fuel, the forward/reverse selector 224 is operated to connect the forward decoder 223 for indexing the respective indicator wheel in the forward or additive counting direction. The forward/reverse selector 224 is switched during the last half or reverse phase of the reset cycle (as hereinafter described) for connecting the reverse decoder 232 for indexing all of the rotary indicators together in the reverse angular direction to "0".

The "sync" or count cycle frequency is selected to establish a fixed predetermined count rate slightly less than the maximum start/stop counting rate of the number wheel 60 and whereby the wheel is indexed at a relatively high rate and yet is at rest at a full count position at the end of each count cycle, thereby avoiding any wheel oscillation or other erratic wheel movement at the beginning of the succeeding count cycle. The maximum reliable start/stop counting rate is a function of the electromagnetic torque produced and the dynamics of the rotor including primarily its moment of inertia. Also, the electromagnetic torque is established in accordance with the rotor dynamics so that the rotor is indexed from each full count position to the succeeding full count position as described. The frequency of the stepping or clock pulse "S" is established at four times the count or "sync" frequency to provide four equal time increment divisions of each count cycle.

A suitable comparator 248 is provided for comparing the BCD output of a slave BCD storage decade 249 with the BCD output of the BCD storage decade 81 (which functions as a master storage decade). When the master and slave BCD storage decades 81, 249 are in agreement, the comparator 248 operates via a count cycle control latch 250 set by the following count or "sync" pulse (at the completion of a count cycle) to close an input control gate 228 and thereby terminate the stepping operation of the forward counter 220. The input control gate 228 remains closed as long as the slave and master decades 249, 81 remain in agreement. When the master decade 81 is indexed, the succeeding "sync" pulse sets the count cycle control latch 250 to open the control gate 228 and connect the 60 hz clocking pulse "S" for indexing the binary counter 220. The first clock pulse "S" to the counter 220 (after the initial "sync" pulse and each succeeding "sync" pulse the input control gate 228 remains open) is effective via a slave decade indexing circuit 251 comprising a gate 253 and a control latch 254 for indexing the slave decade 249 one count.

The relatively high frequency clock pulse "S" from the timing generator 227 will continue to step the counter 220 until the slave decade 249 catches up to the primary decade 81, or the primary decade 81 "laps" or catches up to the slave decade 249 (in either event, when the BCD count of the slave decade 249 equals that of the primary decade 81), whereupon the count cycle control latch 250 will be operated by the succeeding "sync" pulse to close the input control gate 228 (at the end of a full count cycle).

It can be seen that the counter wheel 60 and slave decade 249 are indexed together and that the counter wheel 60 and slave decade 249 are never more than nine counts behind the master decade 81. Also, as the lowest order or hundredths decade 81 is counting at the highest rate and the higher order decades 81 are counting at progressively lower rates, all of the higher order decade wheels 60, depending on the volumetric rate of delivery of fuel and the unit volume price, will normally track their respective BCD decades 81. In any event, preferably all of the decade modules 58 are operated in the same manner and each number wheel is indexed at a maximum available rate by accelerating and then decelerating the number wheel as described.

As the vacuum formed plastic wheel 60 is very light and the inertia of the wheel assembly or rotor is very low as a result, the indicator wheel 60 can be rapidly accelerated and decelerated and can be indexed at a counting rate (e.g., a counting rate of fifteen counts per second) above the visually readable range. Consequently, each indicator wheel being indexed slow enough to be visually readable will be accurately tracking and displaying the count of the respective master BCD storage decade 81. Also, if a fuel delivery is made at a high rate and is then slowed, for example, in order to terminate the delivery at a desired total cost, the cost counter readout will not be discernable (and therefore misleading) before the counter readout corresponds to the count of the binary counter 80.

All of the cost and volume wheels 60 are simultaneously reset to "0" when the switch 34 is closed by turning the handle 36 to its horizontal or "on" position. When the switch 34 is closed, a pulse is generated by a suitable single shot 270 to set all of the master BCD decades 81 to a BCD 9 count and also to set a reset latch 272 of the reset circuit 30. The forward indexing circuits 86 thereupon operate to index the respective counter wheels 60 to their "9" count positions during the first half or phase of the reset cycle. A suitable delay circuit 274 is employed in the reset circuit 30 to provide a minimum delay of nine counts (i.e. nine-fifteenths of a second) for permitting the counter wheels 60 to be indexed a maximum of nine counts from "0" to "9". After the delay (establishing the first or forward phase of the reset cycle), a reverse control latch 276 is set by the succeeding "sync" pulse to open an input control gate 278 for stepping the reset counter 230 at 60 hz. Simultaneously, the reset latch 272 is reset and all of the forward/reverse selectors 224 are operated to connect the reverse decoder 232 for indexing all of the counter wheels 60 together in the reverse direction with the multiple phase counting cycles shown in graphs 3 and 4 of FIG. 5, previously described. After nine full reverse counting cycles i.e., after the reverse connter 230 has been indexed 36 steps), a suitable single shot 280 is operated via a nine count timing circuit 281 to (a) reset the reverse control latch 276 and thereby terminate the reverse reset phase; (b) reset the master and slave decades 81, 249 to "0" and thereby condition the volume and cost accumulators for accumulating the volume and cost of the succeeding delivery; (c) set the motor control latch 40 to energize the pump drive motor 42; and (d) reset the forward and reverse counters 220, 230, and a control latch 284 and divide-by-nine counter 286 of the nine count timing circuit 281 to properly condition the circuits for succeeding counting and resetting cycles.

A full reset cycle therefore comprises a first forward indexing phase for simultaneously indexing all of the counter wheels together forwardly to their "9" count positions and a second reverse indexing phase for indexing all of the counter wheels together in the reverse or subtracting direction to "0". Such a forward and reverse two-phase reset cycle ensures that all of the counter wheels 60 are fully reset to "0". If for any reason a counter wheel 60 is not in synchronism with its slave decade 249 at the beginning of a reset cycle and the wheel is not reset to "9" with its slave decade 249 during the forward reset phase, the following nine count reverse reset phase will provide for resetting the wheel to "0" and the reverse locking pawl 136 will hold the wheel against further reverse rotation beyond "0". Also, as described, each reverse count cycle includes an initial "primary" or A coil opposing pulse during the first time increment to reduce wheel speed and wheel bounce. The initial A coil opposing pulse also provides for stabilizing the counter wheel and prevent forward wheel rotation from "0" during any remaining reverse reset phase steps while the counter wheel remains out of synchronization.

Figure 6:
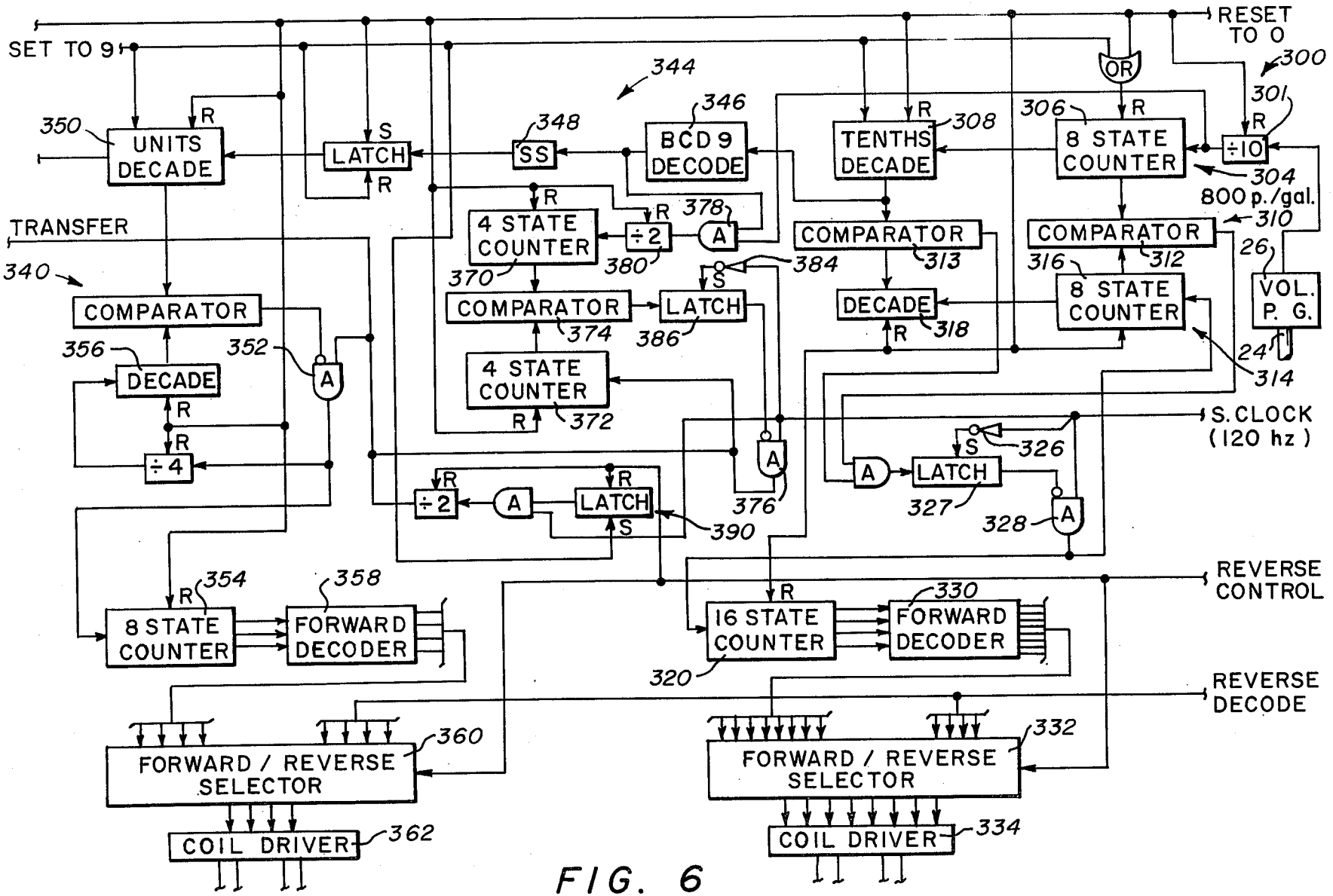
FIG. 6 is a partial functional schematic of a modified rotary indicator drive circuit/providing analogue type wheel operation.

Referring to FIG. 6 and graphs 5-8 of FIG. 5, a modified volume indicator drive system 300 is provided for eliminating the hundredths volume indicator and for indexing (a) the tenths volume indicator with an eight step analogue type drive, and (b) the units and remaining higher order volume indicators with a four step analogue type transfer drive. With the modified drive system 300, the tenths volume indicator (not shown) is preferably marked with the conventional sequence of tenths indicia (i.e. "0/10, 1/10, 2/10 . . . 9/10") for assisting in distinguishing the volume readout from the cost readout.

Referring particularly to FIG. 6, the volume pulse generator 26 is connected via a divide-by-ten input counter section 301 to an eighty state tenths counter section 304 having a lower order eight state binary counter 306 and a higher order ten state binary counter or decade 308. The eighty state tenths counter section 304 is connected to a tenths indicator forward drive circuit 310 composed of comparators 312, 313 and an eighty state slave counter section 314 having a lower order eight state binary counter 316 and a higher order binary decade 318. The comparators 312, 313 and slave counter section 314 cooperate to selectively index a sixteen state forward binary counter 320 generally like the forward counters 220 (previously described with reference to FIG. 2) are selectively indexed. However, with the modified drive circuit 300, the forward counter 320 is indexed one step for each input pulse to the eighty state tenths counter section 304 and whereby the tenths indicator is stepped in small one-eight count increments in analogue fashion.

Using a count or "sync" frequency of 15 hz as in the embodiment of FIGS. 1 and 2, a "S" or clock frequency of 120 hz is used to provide eight stepping pulses for each count. The "S" or clock pulse source is connected via an inverter 326 to set a latch 327 if the slave and master tenths counter sections 314, 304 respectively are in agreement and is connected via an input control gate 328 to index the forward counter 320 and slave counter section 314 at 120 hz as long as the slave and master counter sections 314, 304 are out of agreement. The forward counter 320 (which has sixteen states for a full two count or sixteen step coil energization cycle) is connected via a suitable forward decoder 330, forward-/reverse selector 332 and coil driver 334 for stepping the tenths indicator in accordance with the coil energization cycle depicted in graphs 5 and 6 of FIG. 5. Referring to graphs 5 and 6, the coil driver 334 provides for energizing each coil A and B at two voltage levels V and V/3 in each direction during a full two count coil energization cycle (i.e., 16 steps), and at each step the voltage applied to one of the coils is changed from the prior step to produce a one-eighth count increment of rotation (i.e., $4\frac{1}{2}°$) of the tenths counter wheel. With this analogue type operation, the appropriate coil or coils remain energized at the end of each one-eighth count step and until the succeeding step for retaining the tenths indicator at its proper analogue step position. Also, the tenths indicator is constructed without the extra stator poles 92, 93 and 96 of the "primary" magnetic circuit previously described so that the "primary" and "secondary" magnetic circuits provide for rotating the rotor with equal effect and the eight analogue steps or increments are substantially equal.

Accordingly, the tenths indicator is connected to be indexed each revolution in eighty equal increments or divisions at a maximum rate of 120 steps per second (i.e., 120 hz) and will accurately track the volume delivery of fuel in analogue type fashion as long as the output pulse freqnency to the eighty state tenths counter section 304 is 120 hz or less (or the rate of fuel delivery is 1.5 gallons per second or less).

The units and higher order counter wheels (not shown) are indexed via a slave decade and comparison circuit 340 in a manner very similar to that described with reference to FIG. 2. excepting that through the provision of an intermediate transfer circuit 344, transfer pulses are transmitted to the units and higher order wheels to index those wheels with a four step analogue type transfer as the tenths indicator is stepped in analogue fashion from "9" to "0". For that purpose the transfer circuit 344 employs a BCD 9 decode circuit 346 and a suitable single shot 348 for transmitting a transfer pulse to the units BCD decade 350 when the eighty state tenths counter section 304 reaches its seventy-two count or state (i.e., when the tenths indicator, when on track, reaches its nine or "9/10" count position). The slave decade and comparison circuit 340 of the units indicator drive circuit is thereby set for transmitting (via an input control gate 352), the following four transfer pulses from the transfer circuit 344 for stepping a forward eight state forward counter 354 and index a slave decade 356 one count with the last transfer pulse (and thereby close the gate 352 and terminate the transfer).

The forward counter 354 (having eight states for an eight step two count coil energization cycle) is connected via a suitable forward decoder 358, forward-/reverse selector 360 and coil driver 362 to energize the A and B coils through an eight step two count coil energization cycle as shown in graphs 7 and 8 of FIG. 5. The four step transfer cycle provides for indexing the units and higher order counter wheels in equal 9° increments in essentially the same manner as the reverse count cycle shown in graphs 3 and 4 excepting that the B coil polarity is reversed to index the wheel in the forward direction. Also, as with the tenths indicator, the stators of the units and higher order indicators are preferably constructed without the extra salient poles 92, 93 and 96 of the "primary" magnetic circuit and the appropriate coil or coils remain energized at the end of each step.

The transfer circuit 344 comprises a four state master counter 370, a corresponding four state slave counter 372 and a comparator 374. Those components are connected for transmitting via an input control gate 376 to the units and higher order wheel drive circuits, one transfer pulse for each two input pulses to the tenths counter section 304 during the transfer interval (and so that the four one-fourth count transfer steps occur simultaneously with the second, fourth, sixth and eighth steps) of the tenths counter wheel 60, if tracking, from "9" to "0". For that purpose, the tenths counter section input is also connected via a control gate 378 and a divide-by-two circuit 380 to timely index the master transfer counter 370 one step at each second input pulse to the tenths counter section 304 during the transfer interval. Also, the "S" or clock pulses are operative via an inverter 384 to set a latch 386 when the master and slave counters 370, 372 are in agreement, and the "S" or clock pulses are effective via the input control gate 376 to generate a transfer pulse for indexing the slave transfer counter 372 and for transmission to the units and higher order counter wheel drive circuits (the tens and higher order indicator modules being constructed and indexed in analogue fashion in the same manner as the units indicator).

The tenths, units and higher order indicator wheels are reset in essentially the same manner as they are reset in the embodiment of FIGS. 1 and 2 and using a two phase reset cycle having a first forward reset to "9" phase and a second nine count reverse phase for resetting the counter wheels in the subtractive direction from "9" to "0". Thus the tenths binary decade 308 and the units and higher order binary decades 350 are set at 9 (and the lower order tenths binary counter 306 is set at "0") at the beginning of the reset cycle for resetting the indicator wheels forwardly to "9" during the first reset phase. For that purpose a 60 hz reset pulse train is provided by a stepping circuit 390 during the first reset phase for indexing the units and higher order indicator wheels forwardly to 9 at a rate of sixty steps or fifteen counts per second. The 120 hz "S" or clock pulse source is operative to index the tenths wheel at a rate of one hundred twenty steps or fifteen counts per second.

During the second or reverse phase of the reset cycle, the forward/reverse selectors 332, 360 are set for operating the coil drivers via the reverse decoder 232 (FIG. 2) and with a reverse coil energization cycle as shown in graphs 3 and 4 of FIG. 5 (for the tenths wheels as well as the units and higher order wheels) for indexing all of the indicator wheels together in the reverse angular direction at the rate of fifteen counts per second. For that purpose a 60 hz pulse is supplied to the reset input control gate 278 (FIG. 2) as in the embodiment of FIGS. 1 and 2. At the end of the second or reverse phase of the reset cycle, the accumulator components 301, 306, 308 and 350 and the various counting components of the volume register drive circuit are reset to "0"to condition the circuit for accumulating and registering the volume of the succeeding delivery.

Where desirable, a suitable pulse weighting circuit (not shown) could be employed in place of the input counter section 301 to provide a non-linear eight pulse output cycle for indexing the tenths counter section 304 eight steps in non-linear relationship with the corresponding cycle of eighty pulses generated by the volume pulse generator 26 (i.e. for each one-tenth of a gallon of fuel dispensed). A pulse weighting circuit may be useful, for example, where the unit volume price of gasoline equals or exceeds $0.80 a gallon (and therefore equals or exceeds $0.01 for each one-eighth step of the tenths indicator) for avoiding any apparent inaccuracy in the hundredths or penny cost indicator reading in relationship to the tenths analogue indicator reading. For example, the first output pulse of each eight output pulse (one-tenth gallon) cycle is generated by the pulse weighting circuit (not shown) after one-hundredth gallon of gasoline is delivered (i.e. at the eighth input pulse to the weighting circuit of each cycle of eighty pulses from the volume pulse generator 26) instead of in direct linear relationship with the delivery of fuel after one-eightieth gallon is delivered. The volume tenths indicator is thereby displaced from each readable tenth count before or at least at the same time as the penny or hundredths cost indicator is indexed one cent. Consequently, the cost reading would always accurately correspond to the volume reading when the volume tenths indicator is at an exact tenth count (i.e. the cost reading would equal the product of the volume reading and the posted unit volume price). And when the volume tenths indicator is between counts the cost reading would appear to accurately correspond to the analogue position of the tenths volume indicator wheel.

Also, the remaining seven pulses of each eight output pulse cycle are suitable weighted preferably to be non-linearly spaced during the remaining seventy-two input pulses to the weighting circuit from the pulse generator 26 (i.e. during the delivery of the remaining nine-hundredths gallon of gasoline) so that the cost reading would accurately correspond to the volume reading when the tenths indicator is stepped the eighth or last step to its next tenth count.

It is desirable, particularly with the embodiment of FIGS. 1 and 2, to maintain the wheel stepping torque relatively constant over a wide operational temperature range (e.g. −40° C to +85° C), and thereby maintain the wheel operating characteristics relatively constant and in accordance with the desired design parameters. For that purpose, the salient poles 91 and 95 (and/or the salient poles 94, 97) of each indicator stator are provided with intermediate narrowed sections 400, 402 dimensioned to saturate at the optimum magnetic intensity levels respectively. Thus, at the low end of the operational temperature range when the resistance of each stator winding is, for example, approximately half the resistance at the high end of the operational temperature range (and whereby the current would be approximately twice that at the high end), the narrowed salient pole sections 400, 402 will prevent substantial increase in the rotor operating torque and maintain the torque at generally the desired levels and prevent erratic wheel operation and possible wheel overshoot. Likewise, the narrowed salient pole sections 400, 402 will maintain the operating torque at generally the desired levels at higher applied voltage levels, thereby permitting the indicator to be used over a relatively wide voltage range as well as a wide temperature range.

The magnetic torque produced by the "secondary" magnetic circuit is preferably higher than the magnetic torque produced by the "primary" magnetic circuit because the "secondary" circuit is employed for accelerating the indicator wheel from each full count reset position and decelerating the wheel to the succeeding full count reset position. For that reason, the narrowed stator pole section 400 of the "primary" magnetic circuit is designed to saturate at a lower magnetic intensity level than the narrowed stator pole section 402 of the "secondary" magnetic circuit. Also, the A or "primary" coil is preferably wound, for example with a finer higher resistance wire, to produce a lower NI than the B or "secondary" coil.

As will be apparent to persons skilled in the art, various modifications, adaptations and variations of the foregoing specific disclosure can be made without departing from the teachings of the present invention.

I claim:

1. In a volume and cost registration system for a fuel pump computer having resettable volume and cost registers for registering decimal counts respectively of the volume amount of fuel delivered and the cost amount of fuel delivered in accordance with the volume amount delivered and a pre-established unit volume price, each register comprising a bank of decimal counter wheels of increasing order and electromagnetic wheel indexing means operable for angularly indexing the bank of decimal counter wheels for registering the decimal count of the respective amount of fuel delivered, and cost and volume register drive means for operating the electromagnetic wheel indexing means of the volume and cost registers for indexing the banks of volume and cost counter wheels for registering decimal counts of the volume and cost amounts respectively of fuel delivered as the fuel is delivered, the improvement wherein the electromagnetic wheel indexing means of the cost register is operable for indexing each cost counter wheel digitally for registering the decimal cost count in digital form, wherein the electromagnetic wheel indexing means of the volume register is operable for stepping the lowest order volume counter wheel a plurality of individual steps for each decimal count thereof for registering the decimal volume count in analogue form, and wherein the cost and volume register drive means operates the electromagnetic wheel indexing means of the cost register to register the decimal cost count of fluid delivered in said digital form and operates the electromagnetic wheel indexing means of the volume register to register the decimal volume count of fluid delivered in analogue form with the lowest order volume counter wheel stepped said plurality of individual steps for each decimal count thereof as the fuel is delivered and so that the decimal volume count in said analogue form of the volume register continually substantially corresponds to said decimal cost count in said digital form of the cost register in accordance with said pre-established unit volume price.

2. A volume and cost registration system according to claim 1 wherein the electromagnetic wheel indexing means of each register comprises individual electromagnetic wheel indexing means for each decimal counter wheel having a permanent magnet rotor and an electromagnetic stator with first and second stator windings for successively angularly indexing the permanent magnet rotor to half-count and full count angular positions thereof respectively, the cost and volume register drive means operating the individual wheel indexing means of the cost register for indexing each cost wheel each decimal count by energizing the first stator winding during approximately the first three-fourths of a predetermined fixed count cycle time interval and energizing the second coil during approximately the last half of the fixed count cycle time interval.

3. A volume and cost registration system according to claim 2 wherein the cost and volume register drive means indexes the lowest order volume counter wheel in said analogue form by energizing the first and second stator windings through a count energization cycle having eight steps and with each winding energized at a plurality of applied voltage levels and with the applied voltage of at least one winding being changed at each step.

4. A volume and cost registration system according to claim 3 wherein the cost and volume register drive means comprises a sixteen state stepping counter providing a sixteen step repeating two count cycle, a decoder connected to be operated by the counter and a driver connected to be operated by the decoder to provide a sixteen step repeating two count winding energization cycle for energizing the first and second windings for stepping the lowest order volume counter wheel sixteen steps through a two count cycle, the cost and volume register drive means being operative to step the sixteen state counter for registering the decimal volume count in analogue form as the fuel is delivered.

5. A volume and cost registration system according to claim 1 wherein the electromagnetic wheel indexing means of each register comprises individual electromagnetic wheel indexing means for each decimal counter wheel for selectively indexing the respective wheel in each angular direction, wherein the cost and volume register drive means is selectively operable for resetting each register by operating the individual wheel indexing means thereof through a first forward reset phase providing for forwardly angularly indexing each decimal counter wheel of the register a selected number of decimal counts to presumably reach its 9 decimal count position and then through a second reverse reset phase providing for angularly indexing each decimal counter wheel of the register in the reverse angular direction nine decimal counts to its 0 decimal count position and wherein each register comprises one-way reverse locking means for preventing rotation of each counter wheel thereof in the reverse direction beyond its 0 to its 9 decimal count position, if the counter wheel is indexed to a decimal count other than its 9 decimal count during the forward reset phase.

6. A volume and cost registration system according to claim 1 wherein the electromagnetic wheel indexing means of each register comprises individual electromagnetic wheel indexing means for each decimal counter wheel of the register for selectively indexing the respective wheel in each angular direction, wherein the cost and volume register drive means is selectively operable for resetting each register by operating each individual electromagnetic wheel indexing means thereof for electromagnetically angularly indexing the respective decimal counter wheel in the reverse angular direction nine decimal counts, and wherein each register comprises one-way reverse stop means for preventing rotation of each decimal counter wheel thereof in the reverse direction beyond its 0 to its 9 decimal count position.

7. In a counting system having an electromagnetic decade counter with a decade counter wheel having ten equiangularly spaced, decimal count positions and a permanent magnet with a coaxial annular arrangement of an even plurality of equiangularly spaced alternating north and south salient poles, and an electromagnetic stator having a stator core with a plurality of angularly spaced salient poles providing first and second magnetic circuits respectively oriented one-half count out of phase and in phase relative to the salient poles of the counter wheel in each decimal count position thereof, and only first and second stator coil windings on the stator core adapted to be independently selectively energized in each direction for selectively magnetizing the first and second magnetic circuits respectively in each direction, and decade counter drive means for selectively energizing the first and second stator coil windings for selectively indexing the decade counter wheel to each succeeding decimal count, the decade counter drive means being operable for indexing the counter wheel to each succeeding decimal count from a prior decimal count by energizing the first stator winding in a selected direction in accordance with said prior decimal count of the counter wheel and the desired direction of rotation during a first fixed predetermined initial time portion of a predetermined fixed count cycle time interval and providing for angularly biasing the counter wheel in the desired direction of rotation from said prior decimal count and energizing the second coil in a selected direction in accordance with said prior decimal count of the counter wheel during a second fixed predetermined final time portion of said fixed time interval less than said first fixed initial time portion and providing for biasing the counter wheel in the desired direction of rotation to said succeeding decimal count.

8. A counting system according to claim 7 wherein said first predetermined initial time portion is approximately the first three-fourths of said fixed time interval and wherein said second predetermined final time portion is approximately the last half of said fixed time interval.

9. A counting system according to claim 7 wherein the decade counter drive means is selectively operable for resetting the decade counter to a predetermined decimal count by energizing the stator coil windings through a first reset phase for the purpose of indexing the counter wheel in a first direction to the decimal count immediately preceding said predetermined decimal count and then through a second reset phase for the purpose of indexing the wheel in the reverse angular direction nine counts to said predetermined decimal count, and wherein the electromagnetic decade counter comprises one-way retaining means for retaining the decade counter wheel against said reverse rotation beyond said predetermined decimal count.

10. A counting system according to claim 9 wherein the second reset phase further comprises energizing the second stator winding during a third predetermined initial time portion of said fixed time interval in a selected direction opposing said reverse rotation of the decade.

11. In a rotary electromagnetic indicator comprising an indicating rotor with an even plurality of equiangularly spaced digital indicating positions and having a permanent magnet with an annular arrangement of an even plurality of alternating north and south salient poles for said plurality of equiangularly spaced digital indicating positions respectively, and a stator with a stator core with a plurality of angularly spaced salient poles each adapted to be aligned with each pole of the rotor permanent magnet as the indicating rotor is rotated through 360°, the stator core having first and second separate magnetic circuits in approximately one-half digit out of phase relationship, the first magnetic circuit having a first salient pole and at least one additional salient pole angularly spaced therefrom for respective alignment with rotor poles of opposite polarity, the second magnetic circuit having a first salient pole and a plurality of additional salient poles with at least one more of said additional poles than in said first magnetic circuit, angularly spaced from the first pole of the second circuit for respective alignment with rotor poles of opposite polarity, and first and second stator coil windings on the stator core for selectively magnetizing the first and second magnetic circuits in each direction.

12. A rotary electromagnetic indicator according to claim 11 wherein said first magnetic circuit comprises only one said additional pole.

13. A rotary electromagnetic indicator according to claim 12 wherein said second magnetic circuit comprises four said additional poles.

14. A rotary electromagnetic indicator according to claim 11 wherein the indicating rotor comprises an annular arrangement of ten salient poles for angularly positioning the indicating rotor in each of ten equiangularly spaced digital indicating positions.

15. A rotary electromagnetic indicator according to claim 11 wherein the indicating rotor has a vacuum formed plastic indicator shell with an outer generally cylindrical rim with separate indicia at each of said equiangularly spaced digital indicating positions, and axially extending equiangularly spaced vacuum formed ribs intermediate the indicia.

16. A rotary electromagnetic indicator according to claim 11 wherein the stator core comprises an annular ring generally coaxial with the indicating rotor and wherein the salient stator poles extend radially inwardly from the annular ring within a place generally normal to the axis of the indicating rotor.

17. A rotary electromagnetic indicator according to claim 11 wherein the rotor permanent magnet comprises a coaxial generally axially magnetized permanent magnet with axially spaced end faces and a pair of coaxial oppositely facing pole pieces in engagement with the end faces of the permanent magnet, each of the pole pieces having a plurality of equiangularly spaced axially extending pole segments forming a plurality of rotor poles of the same polarity.

18. In a counting system having a bank of a plurality of rotary electromagnetic decade counters of increasing order; each having a decade counter wheel with ten equiangularly spaced decimal count positions and a permanent magnet with a coaxial annular arrangement of ten equiangularly spaced alternating north and south salient poles for the ten count positions respectively, and an electromagnetic stator with a stator core with a plurality of angularly spaced salient poles providing first and second magnetic circuits in half count out of phase angularly spaced relationship, and first and second separate stator coil windings on the stator core adapted to be independently selectively energized in each direction for selectively magnetizing the first and second magnetic circuits respectively in each direction, and counter drive means for selectively energizing the first and second windings of the bank of decade counters for indexing the bank of decade counter wheels for counting, the counter drive means being operable for indexing the lowest order decade counter by selectively energizing the first and second stator windings thereof in selected predetermined directions and at fixed predetermined time intervals providing a respective plurality of individual steps of the lowest order counter wheel for each decimal count thereof for stepping the lowest order counter wheel the said plurality of individual steps in analogue form for each decimal count thereof.

19. A counting system according to claim 18 wherein the counter drive means is operable for indexing each higher order decade counter by selectively energizing the first and second stator windings thereof to step the respective counter wheel a plurality of individual steps in synchronism with individual steps of the lowest order decade counter wheel.

20. A counting system according to claim 19 wherein the lowest order decade counter wheel is indexed by stepping it eight individual steps in analogue form for each decimal count and wherein each higher order decade wheel is indexed by stepping it four individual steps in analogue form in synchronism with the second, fourth, sixth and eighth steps of the lowest order decade counter wheel.

21. A counting system according to claim 18 wherein the lowest order decade counter wheel is indexed by stepping it eight individual steps in analogue form for each decimal count thereof.

22. A method of counting by electromagnetically angularly indexing a rotary counter wheel in one angular direction thereof to a plurality of successive equiangularly spaced count positions thereof with first and second electromagnetic indexing means respectively in phase and one-half count out of phase with the count positions of the rotary counter wheel, the first and second electromagnetic indexing means being adapted to be individually selectively energized to electromagnetically bias the counter wheel in said one angular direction from each prior count position and to the succeeding count position respectively, the method of indexing the counter wheel each count in said one angular direction comprising the steps of selectively energizing the first and second electromagnetic indexing means through a predetermined multiple phase count cycle having a predetermined fixed time interval including energizing the second electromagnetic indexing means during an initial fixed time portion of the fixed time interval for angularly biasing the counter wheel in said one angular direction from its prior count position and energizing the first electromagnetic indexing means during a final fixed time portion of the fixed time interval less than said initial fixed time portion for angularly biasing the counter wheel toward said succeeding count position.

23. A method of counting according to claim 22 wherein the second electromagnetic indexing means is energized during an initial portion of the fixed time interval for biasing the counter wheel in said one angular direction from its prior count position and then in the opposite angular direction as the counter wheel rotates in said one angular direction through an intermediate approximately half count position.

24. A method of counting by electromagnetically angularly indexing a rotary counter wheel in one angular direction to a plurality of successive equiangularly spaced full count positions thereof by indexing the counter wheel in said one angular direction from each prior full count position to the succeeding full count position with first and second electromagnetic indexing means respectively in phase and one-half count out of phase with the full count positions of the rotary counter wheel, the second electromagnetic indexing means being adapted to be selectively energized in opposite directions for selectively attracting the counter wheel in said one angular direction toward and repelling it in the opposite angular direction from the succeeding half count angular position respectively, and the first electromagnetic indexing means being adapted to be selectively energized in opposite directions to attract the counter wheel to and repel it from the full count angular position of the counter wheel, the method comprising the steps of energizing the first and second electromagnetic indexing means through a multiple step count cycle having at least four individual start/stop steps for indexing the counter wheel the same number of generally equal angular increments in analogue form from each prior full count position to the succeeding full count position.

25. A method of counting according to claim 24 wherein the multiple step count cycle comprises four of said individual start/stop steps provided by energizing the second electromagnetic indexing means at the first, second and third steps in a direction biasing the counter wheel to the succeeding half count position, energizing the first electromagnetic indexing means at the first step in a direction biasing the counter wheel to the prior full count position and energizing the first electromagnetic indexing means in the opposite direction at the third and fourth steps biasing the counter wheel to its succeeding full count position.

26. A method of counting according to claim 24 wherein the multiple step count cycle comprises eight of said individual start/stop steps.

27. A rotary electromagnetic indicating system comprising an indicating rotor with an even plurality of equiangularly spaced digital indicating positions and having a permanent magnet with an annular arrangement of an even plurality of alternating north and south salient poles for said plurality of equiangularly spaced digital indicating positions respectively, and a stator with a stator core having an annular ring generally coaxial with the indicating rotor and a plurality of angularly spaced salient poles extending radially inwardly from the annular ring within a plane generally normal to the axis of the indicating rotor, each of said salient poles being adapted to be aligned with each pole of the rotor permanent magnet as the indicating rotor is rotated through 360°, the stator core ring and salient poles providing first and second separate magnetic circuits in approximately one-half digit out-of-phase relationship, the first magnetic circuit having a first salient pole and at least one additional salient pole angularly spaced therefrom for respective alignment with rotor poles of opposite polarity, the second magnetic circuit having a first salient pole and at least one additional salient pole angularly spaced therefrom for respective alignment with rotor poles of opposite polarity, and first and second separate salient pole windings on said first salient poles of the first and second magnetic circuits respectively, and electromagnet drive means connected to the first and second separate windings and selectively operable for selectively digitally indexing the indicating rotor from each rest digital indicating position thereof to its succeeding digital indicating position by selectively energizing at least one of the separate salient pole windings for a controlled time interval and in a controlled direction for angularly accelerating the indicating rotor from each digital indicating position thereof toward its succeeding digital position and then decelerating the indicating rotor to a rest at its said succeeding digital position.

28. A resettable register for a fuel pump for registering a multiple place amount of fuel delivered and comprising a bank of decade counters having a bank of coaxial decade counter wheels of increasing place respectively each having ten equiangularly spaced decimal count positions; each decade counter having electromagnetic wheel indexing means for the respective decade counter wheel adapted to be selectively energized for indexing the decade counter wheel in one angular direction thereof from a prior count position to a succeeding count position; the electromagnetic wheel indexing means of each decade counter comprising a salient pole permanent magnet rotor, a salient pole electromagnetic stator cooperable therewith and having an annular ring generally coaxial with the rotor and a plurality of angularly spaced salient stator poles extending radially inwardly from the annular ring within a plane generally normal to the axis of the rotor, each of said salient stator poles being adapted to be aligned with each salient pole of the permanent magnet rotor as the rotor is rotated through 360°, and stator winding means adapted to be selectively energized through a count cycle thereof for selectively indexing the decade counter wheel in one angular direction thereof from a prior count rest position to a succeeding count rest position; and register drive means for selectively energizing the stator winding means of the bank of decade counters in controlled directions and for controlled time intervals for selectively indexing the bank of counter wheels for registering the amount of fuel delivered, the register drive means comprising first electronic counter means connected to be indexed for electronically registering said amount of fuel delivered, and electrical drive means for automatically selectively energizing the stator winding means of the bank of decade counters in controlled directions and for controlled time intervals for selectively indexing the bank of counter wheels for counting at a predetermined fixed rate and with each decade counter wheel at least momentarily held at rest at each count until the bank of decade counter wheels registers a count corresponding to the count of the first electronic counter means.

29. A resettable register according to claim 28 wherein the electromagnetic drive means comprises a bank of second electronic counters for the bank of decade counters respectively, each adapted to be repetitively indexed in a predetermined counting direction through a count sequence of ten counts corresponding to the ten decimal count positions of the respective decade counter wheel, electrical indexing means for indexing each second electronic counter at said predetermined fixed rate and for energizing the stator winding means of the respective decade counter in a controlled direction and for a controlled time interval for indexing the respective counter wheel at said predetermined fixed rate, comparator means for comparing the place count of each second electronic counter with the corresponding place count of the first electronic counter means, and electrical control means operable by the comparator means for selectively connecting the electrical indexing means for selectively idexing each second electronic counter and the respective counter wheel at said fixed rate until the count of the second electronic counter corresponds to the respective place count of the first electronic counter means.

* * * * *